US006092515A

United States Patent [19]

Morikawa

[11] Patent Number: 6,092,515

[45] Date of Patent: Jul. 25, 2000

[54] AIR-FUEL RATIO CONTROL SYSTEM FOR INTERNAL COMBUSTION ENGINE

[75] Inventor: Junya Morikawa, Toyota, Japan

[73] Assignee: Denso Corporation, Kariya, Japan

[21] Appl. No.: 09/053,043

[22] Filed: Apr. 1, 1998

[30] Foreign Application Priority Data

Apr. 2, 1997 [JP] Japan ..... 9-083725

[51] Int. Cl.[7] ..... F02M 33/04

[52] U.S. Cl. ..... 123/698

[58] Field of Search ..... 123/698, 518, 123/519, 520

[56] References Cited

U.S. PATENT DOCUMENTS

| | | | |
|---|---|---|---|
| 4,683,861 | 8/1987 | Breitkreuz et al. . | |
| 5,224,462 | 7/1993 | Orzel | 123/698 |
| 5,363,830 | 11/1994 | Morikawa . | |
| 5,529,047 | 6/1996 | Aota et al. . | |
| 5,634,454 | 6/1997 | Fujita | 123/698 |
| 5,699,778 | 12/1997 | Muraguchi et al. | 123/698 |
| 5,727,537 | 3/1998 | Nakagawa et al. | 123/698 |

FOREIGN PATENT DOCUMENTS

| | | |
|---|---|---|
| 5-248312 | of 0000 | Japan . |
| 7-293361 | of 0000 | Japan . |
| 7-59917 | of 0000 | Japan . |

*Primary Examiner*—Erick Solis
*Attorney, Agent, or Firm*—Nixon & Vanderhye P.C.

[57] ABSTRACT

A system that performs a highly precise air-fuel ratio control by considering the effect of purge. During an air-fuel ratio feedback operation, an amount of purge control AFPRG is calculated according to the following equation by the use of an actual TAU (actual amount of fuel injection) (step 602).

AFPRG=actual TAU/(TP×FTHA×FPA)−(FTC+FPRG+FLAF)

where TP represents a basic amount of injection, FTHA represents a suction air temperature correction factor, FPA represents an atmospheric pressure correction factor, FTC represents an acceleration/deceleration correction factor, FPRG represents a purge correction factor, and FLAF represents an air-fuel ratio learning correction factor. The characterizing features of the above equation reside in that (1) the amount of purge control AFPRG is calculated with the use of the actual TAU and (2) the amount of purge control AFPRG is calculated by excluding air-fuel ratio fluctuating factors (warm-up correction factor, start-up time correction factor, post-startup correction factor and fuel cut restoration time correction factor) other than the purge factor, and by using only an air-fuel ratio fluctuating purge factor.

18 Claims, 12 Drawing Sheets

FIG 5

FULL-OPEN PURGE PERCENTAGE MAP (RPRGMX)

(mmHg)

| NE \ PM | 291 | 369 | 447 | 525 | 603 | 651 | 759 |
|---|---|---|---|---|---|---|---|
| 800 | 20.1 | 14.5 | 11.2 | 8.6 | 6.2 | 4.6 | 0.0 |
| 1200 | 12.5 | 9.3 | 7.2 | 5.5 | 4.0 | 2.9 | 0.0 |
| 1600 | 9.3 | 6.8 | 5.3 | 4.0 | 2.9 | 2.1 | 0.0 |
| 2000 | 7.9 | 5.7 | 4.4 | 3.3 | 2.4 | 1.8 | 0.0 |
| 2400 | 6.0 | 4.5 | 3.5 | 2.6 | 1.9 | 1.4 | 0.0 |
| 2800 | 5.5 | 4.1 | 3.1 | 2.3 | 1.7 | 1.2 | 0.0 |
| 3200 | 4.9 | 3.6 | 2.7 | 2.0 | 1.5 | 1.1 | 0.0 |
| 3600 | 4.1 | 3.0 | 2.2 | 1.7 | 1.3 | 0.9 | 0.0 |
| 4000 | 3.4 | 2.4 | 1.8 | 1.4 | 1.1 | 0.8 | 0.0 |

(rpm) (%)

FIG. 6

TARGET TAU CORRECTION AMOUNT KTPRG (mmHg)

| NE \ PM | 300 | 350 | 400 | 450 | 500 | 550 | 600 | 650 | 700 | 750 |
|---|---|---|---|---|---|---|---|---|---|---|
| 500 | -30 | -30 | -30 | -35 | -35 | -35 | -35 | -40 | -40 | -40 |
| 1000 | -30 | -30 | -30 | -35 | -35 | -35 | -35 | -40 | -40 | -40 |
| 1500 | -30 | -30 | -30 | -35 | -35 | -35 | -35 | -40 | -40 | -45 |
| 2000 | -35 | -35 | -35 | -35 | -35 | -40 | -40 | -40 | -45 | -45 |
| 2500 | -35 | -35 | -35 | -35 | -40 | -40 | -45 | -45 | -50 | -50 |
| 3000 | -40 | -40 | -40 | -40 | -40 | -40 | -45 | -50 | -50 | -50 |
| 3500 | -40 | -40 | -40 | -40 | -40 | -45 | -50 | -50 | -50 | -50 |
| 4000 | -40 | -40 | -40 | -40 | -45 | -45 | -50 | -50 | -50 | -50 |

(rpm)

CALCULATION METHOD FOR PURGE PERCENTAGE GRADUAL CHANGE VALUE RPRGD (a) WHEN 0.8<PURGE CONTROL AMOUNT AFPRG<1.2

(b) WHEN PURGE CONTROL AMOUNT AFPRG ≦ 0.8 OR PURGE CONTROL AMOUNT AFPRG > 1.2

RPRGD = RPRG(i-1) − β (VALVE CLOSED)

DETECT FUEL EVAPORATIVE EMISSION GAS CONCENTRATION

401
KEY SWITCH AT "ON" TIME ?
YES
NO
402
XPRG=1?
NO
YES
403
DURING ACCELERATION OR DECELERATION ?
YES
NO
404
XNFLPRG=1?
NO
YES
405
RPRG>β%?
NO
YES
406
AFPRGSM−1?
−0.02>
−0.02≦, ≦+0.02
>+0.02
408
FLPRG =FLPRG(i-1)-b
409
FLPRG =FLPRG(i-1)
410
FLPRG =FLPRG(i-1)+a
411
XNFLPRG=1?
YES
NO
412
STABILIZED?
NO
YES
413
XNFLPRG=1
414
CALCULATE FLPRGAV
RETURN
415
FLPRG=0
416
FLPRGAV=0
417
XNFLPRG=0
RETURN

UPDATING METHOD FOR LEARNED VALUE OF FUEL EVAPORATIVE EMISSION GAS CONCENTRATION FLPRG (PROVIDED HOWEVER THAT a > b)

AIR-FUEL RATIO CONTROL SYSTEM FOR INTERNAL COMBUSTION ENGINE

CROSS-REFERENCE TO RELATED APPLICATION

The present application is related to and claims priority from Japanese Patent Application No. Hei 9-83725, filed on Apr. 2, 1997, incorporated herein by reference.

BACKGROUND OF THE INVENTION

1. Field of the Invention

The present invention relates to an air-fuel ratio control system for an internal combustion engine, which is loaded thereon and has incorporated therein a fuel evaporative emission gas purge system for purging (releasing) an evaporated fuel adsorbed within a canister to a suction system of the internal combustion engine.

2. Description of the Related Art

In a fuel evaporative emission gas purge system, the fuel evaporative emission gas is adsorbed within a canister to prevent a fuel evaporative emission gas (HC) generated within a fuel tank from leaking into the atmospheric air. Also, a purge control valve is provided on a midway portion of a purge passage for purging the fuel evaporative emission gas adsorbed within the canister to a suction pipe of the internal combustion engine. By the use of this purge control valve, the amount of the fuel evaporative emission gas purged from the canister to the suction pipe is controlled.

Conventionally, as shown in Japanese Examined Patent Application Laid-Open Publication No. Hei 7-59917 or Japanese Patent Application Laid-Open No. Hei 7-293361, the amount of purge is controlled according to an air-fuel feedback correction factor FAF given as a control output of an air-fuel ratio feedback control (lambda control). Here, the air-fuel ratio feedback correction factor FAF is expressed by the following equation, using a calculated value of an amount of fuel injection TAU (hereinafter referred to simply as "the calculated TAU").

$$FAF=\text{calculated TAU}/(TP\times FTHA\times FPA)-(FWL+FSE+FASE+FFC+FTC+FPRG+FLAF)$$

where TP: basic amount of injection (basic time period of injection)

FTHA: suction air temperature correction factor

FPA: atmospheric pressure correction factor

FWL: warm-up correction factor

FSE: start-up time correction factor

FASE: post-startup correction factor

FFC: fuel cut restoration time correction factor

FTC: acceleration/deceleration correction factor

FPRG: purge correction factor, and

FLAF: air-fuel ratio learning correction factor

It is to be noted that the above equation, which represents the FAF, can be determined by solving the following equation for the calculated TAU.

$$\text{Calculated TAU}=TP\times FTHA\times FPA\times(FWL+FSE+FASE+FFC+FTC+FPRG+FLAF)$$

Meanwhile, with respect to the calculated TAU, a lower-limit guard value TAUmin and an upper-limit guard value TAUmax are set. Both values correspond to minimum/maximum amounts of injection of the fuel injection valve.

When the calculated TAU falls outside the range of TAUman≦calculated TAU≦TAUmin, the calculated TAU is guard processed by the TAUmin or TAUmax, with the result that the calculated TAU=TAUmin or TAUmax. Accordingly, in the region wherein the calculated TAU is outside the range of from the guard value TAUmin to the guard value TAUmax, the amount of fuel injected from the fuel injection valve (hereinafter referred to simply as "the actual TAU") differs from the calculated TAU. For this reason, when control of the amount of purge is performed using the air-fuel ratio feedback correction factor FAF as in the prior art, the amount of purge control becomes an incorrect value that does not correspond to the actual TAU in the region wherein the calculated TAU is outside the range of from the guard value TAUmin to the guard value TAUmax. This makes it impossible to perform an accurate air-fuel ratio feedback control based on the consideration of the effect of purge, which results in deterioration of exhaust emission control.

In addition, in the second member of the right side of the above equation representing the FAF, air-fuel ratio fluctuating factors (the warm-up correction coefficient or factor FWL, start-up time correction factor FSE, post-startup correction factor FASE and fuel cut restoration time correction factor FFC) other than purge are included. Therefore, it is impossible to take out only an FAF fluctuated portion resulting solely from purge. Accordingly, when determining the amount of purge control according to the FAF as in the prior art, as other air-fuel ratio fluctuating factors than purge are contained also in the amount of purge control, it is impossible to perform accurate purge control. Therefore, it is impossible to perform an accurate air-fuel ratio feedback control based on the consideration of the effect of purge.

SUMMARY OF THE INVENTION

An object of the present invention is to provide an air-fuel ratio control system for an internal combustion engine which enables the performance of highly precise air-fuel feedback control based on the consideration of the effect of purge.

To attain the above object, the air-fuel ratio control system according to a first aspect of the present invention calculates an amount of fuel injection according to the operational conditions of an internal combustion engine. The system then guard processes a calculated value of this amount of fuel injection and determines an amount of fuel injected actually from a fuel injection valve (hereinafter referred to as "the actual amount of fuel injection"), and calculates an amount of control of a fuel evaporative emission gas purged (hereinafter referred to as "the amount of purge control") from a canister according to this actual amount of fuel injection.

According to this air-fuel ratio control system, since the amount of purge control is calculated according to the actual amount of fuel injection that is obtained after the guard processing has been executed, it is possible to determine the amount of purge control corresponding to the actual amount of fuel injection. Therefore, it is possible to perform a highly precise air-fuel ratio feedback control based on the consideration of the effect of purge.

If the purge control valve is controlled according to the amount of purge control thus determined, it becomes possible to perform a highly precise purge control (a second aspect of the present invention).

Further, according to a third aspect of the present invention, preferably, the amount of purge control is calculated by using the actual amount of fuel injection and only an air-fuel ratio fluctuating purge factor among the air-fuel ratio fluctuating factors as parameters. By performing such a calculation, it is possible to take out only a fluctuated portion resulting solely from purge. This makes it possible to perform a highly precise purge control and therefore to perform a highly precise air-fuel feedback control based on the consideration of the effect of purge.

Incidentally, calculation of the amount of purge control that is made using the air-fuel ratio fluctuating purge factor may be performed using only this purge factor alone (according to a sixth aspect of the present invention) without using an actual amount of fuel injection. Even when using a calculated value of the amount of fuel injection that precedes the guard processing as a parameter as in the conventional case, if the amount of purge control is calculated using the air-fuel ratio fluctuating purge factor as a parameter, it is possible to enhance the purge control precision and, further, even the air-fuel ratio feedback control precision, when compared to conventional purge control systems in which fluctuating factors other than purge are also used.

Also, according to a fourth aspect of the present invention, the fuel concentration of the purge gas may be learned according to the amount of purge control, to correct the amount of fuel injection according to a learned value. In this case, since the amount of purge control calculated according to the actual amount of fuel injection is more accurate than in the prior art, if the fuel concentration of the purge gas is learned according to this amount of purge control, it is possible to learn the fuel concentration of the purge gas with a precision higher than that in the prior art, and also to enhance the precision with which the amount of fuel injection is corrected by way of purge.

Also, according to a fifth aspect of the present invention, the percentage of purge may be calculated according to the amount of suction air and the flowrate of the purge gas. The degree of opening of the purge control valve can thereby be controlled according to the amount of purge control by setting this percentage of purge as a target. By performing such calculation, it is also possible to enhance the precision with which the percentage of purge is calculated. This leads to the enhancement of the precision with which purge is controlled.

BRIEF DESCRIPTION OF THE DRAWINGS

FIG. 5 is a table illustrating an example of a total-open purge percentage map;

FIG. 6 is a table illustrating an example of a target TAU correction amount map;

DETAILED DESCRIPTION OF THE PREFERRED EMBODIMENT

Figure 1:
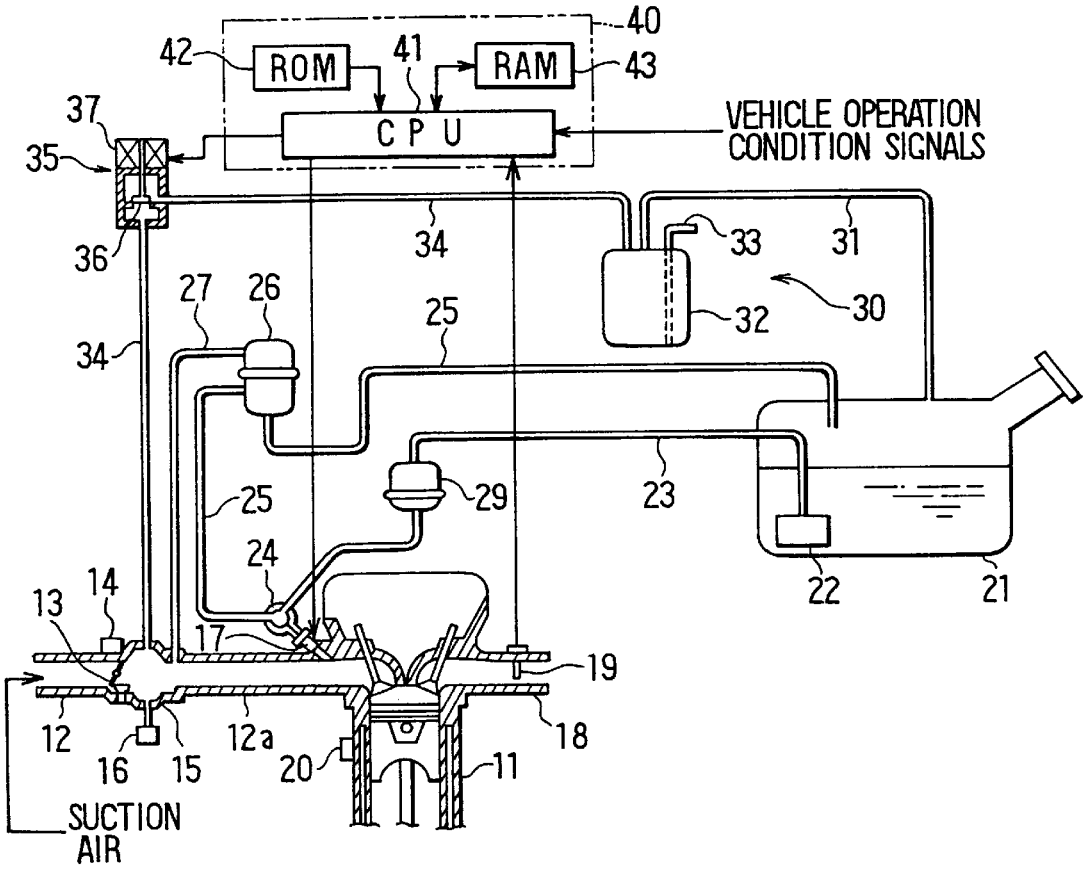
FIG. 1 is a schematic view illustrating an entire system according to an embodiment of the present invention.

An embodiment of the present invention will now be described with reference to the drawings. First, the schematic construction of an entire system will be explained with reference to FIG. 1. A throttle valve 13 is provided on a midway portion of a suction pipe 12 of an internal combustion engine. The degree of opening of this throttle valve 13 is sensed by a throttle sensor 14. With respect to a surge tank 15 provided on the downstream side of the throttle valve 13, a suction air pressure sensor 16 is provided for sensing the pressure of a suction air having passed through the throttle valve 13. A fuel injection valve 17 for injecting fuel supplied from fuel tank 21 is mounted on suction manifold 12*a* for introducing the suction air having passed through the surge tank 15 into each cylinder. Also, on an exhaust pipe 18 of the engine 11, an oxygen sensor 19 is provided for outputting a signal corresponding to the oxygen concentration in the exhaust gas. Further, a cooling water temperature sensor 20 for sensing the temperature of a cooling water for cooling the engine 11 is mounted on an engine cylinder block.

Still referring to FIG. 1, fuel within the fuel tank 21 is pumped by a fuel pump 22. The fuel sent on from the fuel tank 21 through a fuel pipe 23 is filtered by a fuel filter 29 and is sent to a delivery pipe 24, from which the fuel is distributed to the fuel injection valve 17 of each cylinder. Also, an excess fuel within the delivery pipe 24 is returned to the fuel tank 21 through a return pipe 25. On a midway portion of this return pipe 25 there is provided a pressure regulator 26. A back pressure chamber of the regulator communicates with the surge tank 15 through a pressure introduction pipe 27 to introduce the suction pressure to the back pressure chamber of the pressure regulator 26, thereby making an adjustment so that the pressure difference between the fuel pressure within the delivery pipe 24 and the suction pressure may become fixed.

Next, the construction of a fuel evaporative emission gas purge system 30 will be explained. A canister 32 is connected to the fuel tank 21 through a communication pipe 31. Within this canister 32 there is accommodated an adsorber (not illustrated) such as activated carbon for adsorbing a fuel evaporative emission gas. Also, on the canister 32 there is provided an atmospheric air communication pipe 33 for communication with atmospheric air. Between the canister 32 and the surge tank 15 there is provided a purge passage 34 for purging (releasing) the fuel evaporative emission gas adsorbed within the canister 32 to the suction pipe 12. On a midway portion of this purge passage 34 there is provided a purge control valve 35 for controlling the flowrate of the purge gas.

Figure 2:
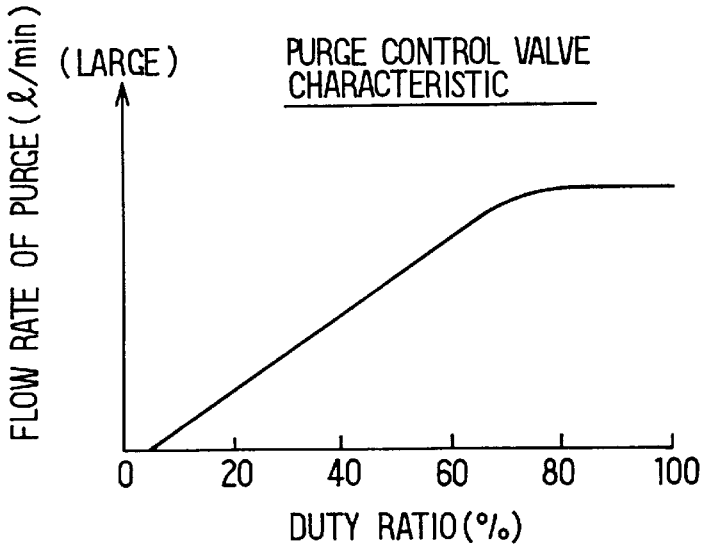
FIG. 2 is a graph illustrating the relationship between a purge control valve driving duty and a purge flowrate.

This purge control valve 35 is an electromagnetic valve which is equipped with a valving element 36 for opening or closing its internal gas flow passage, a solenoid coil 37 for moving this valving element 36 against a spring (not illustrated) in a direction of opening the valve, and additional valve components. A pulse signal voltage is applied to the solenoid coil 37 of this purge control valve 35. By changing the ratio of the pulse width to the period of this pulse signal (duty ratio), the degree of opening of the valving element 36 is adjusted to control the flowrate of the purged fuel evaporative emission gas that is purged from the canister 32 to the suction pipe 12. The characteristic of change of the flowrate of the purge gas relative to the duty ratio applied to the purge control valve 35 is illustrated in FIG. 2.

Various data items representing the operational condition of the engine from the above-described various sensors are input to an engine control circuit. These input data items are processed in a CPU 41 that controls air-fuel ratio feedback, fuel injection, ignition, fuel evaporative emission gas purge and other engine control functions. Within this engine control circuit 40 there are contained a ROM (storage medium) 42 having stored therein data such as various control programs and maps and a RAM 43 for temporarily storing data such as input data and calculation data. An explanation will hereafter be given of the control functions, such as air-fuel ratio feedback control, fuel injection control, and fuel evaporative emission gas purge control, which are executed by the engine control circuit 40.

[Air-Fuel Ratio Feedback Control]

Figure 3:
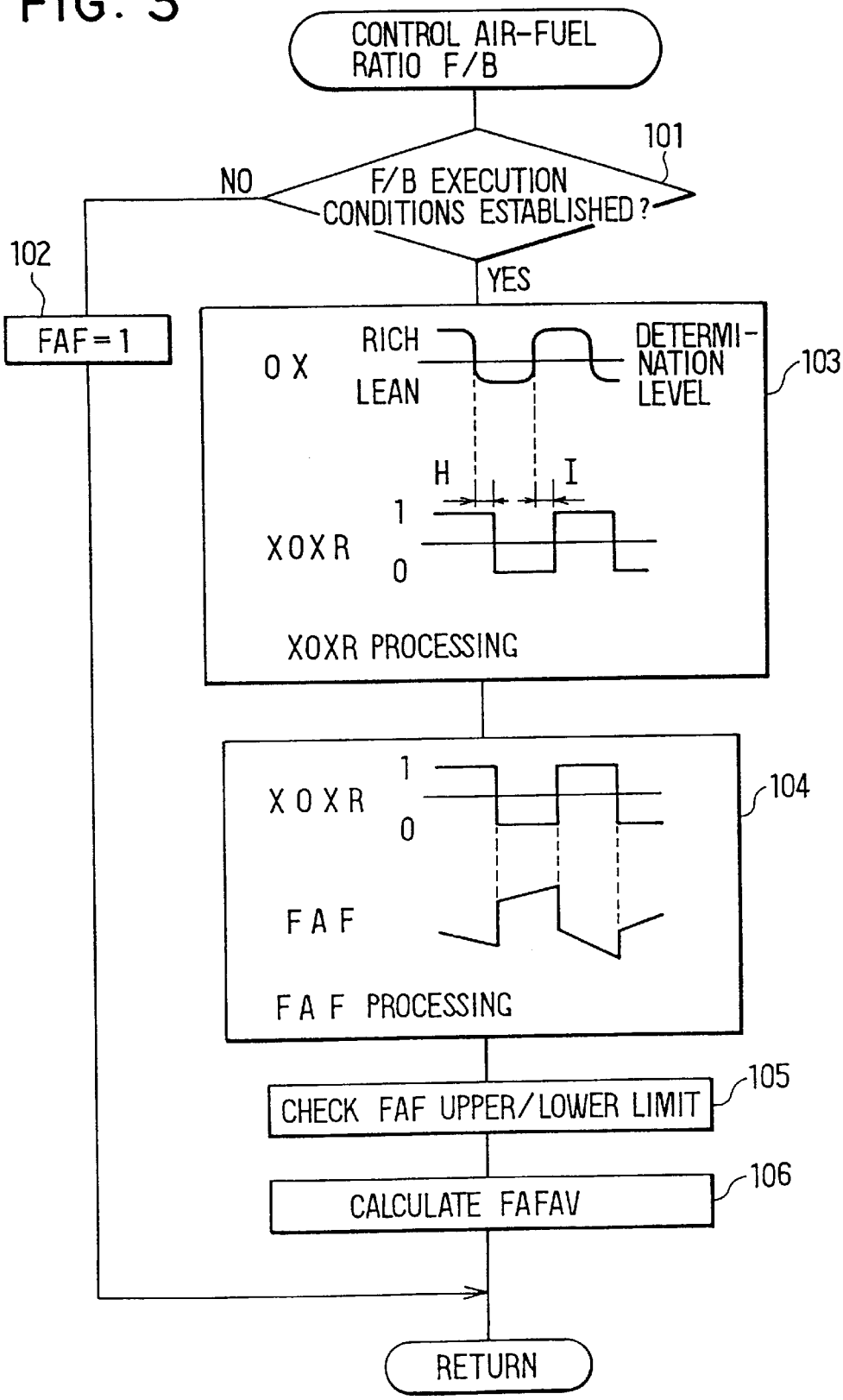
FIG. 3 is a flow diagram illustrating the flow of a process for executing an air-fuel ratio feedback control program.

The air-fuel ratio feedback control is executed as an interruption process, for example, every 4 milliseconds, according to an air-fuel ratio feedback control program illustrated in FIG. 3. At the start of the process according to this program, at step 101, it is determined whether the feedback execution conditions are established. Here, feedback execution conditions include, for example: (1) the operational state of the engine is not at the time when the engine has been started, (2) the supply state of the fuel is not during a fuel cut, (3) the cooling water temperature THW≧40° C., (4) the fuel injection amount TAU>TAUmin (where the TAUmin represents a minimum amount of fuel injection of the fuel injection valve 17), and (5) the oxygen sensor 19 for sensing the oxygen concentration of the exhaust gas is in an activated state. When all of conditions (1) to (5) are satisfied, the feedback execution conditions are established. When these feedback execution conditions are not established, the routine proceeds to step 102 where the air-fuel ratio feedback correction factor FAF is set to be "1.0", and the program is ended.

On the other hand, when the feedback execution conditions are established, the routine proceeds to step 103 where the output of the oxygen sensor 19 is compared with a prescribed determination level. An air-fuel ratio flag XOXR is manipulated by delaying this output by prescribed time lengths H and I (msec). Specifically, after the lapse of the H (msec) after the inversion of the output of the oxygen sensor 19 from "rich" to "lean", the XOXR is set to be the XOXR=0 ("lean"). After the lapse of the I (msec) after the inversion of the output of the oxygen sensor 19 from "lean" to "rich", the XOXR is set to be the XOXR=1 ("rich").

At step 104, the value of the air-fuel ratio feedback correction factor FAF is manipulated according to the air-fuel ratio flag XOXR as follows. That is, when the air-fuel ratio flag XOXR has changed from "0" to "1" or from "1" to "0", the value of the air-fuel ratio feedback correction factor FAF is skipped by a prescribed amount. When the air-fuel ratio XOXR goes on with "1" or "0", integration control of the air-fuel ratio feedback correction factor FAF is performed. Thereafter, at step 105, lower-limit checking (guard processing) is performed of the value of the air-fuel ratio feedback correction factor FAF. Subsequently, at step 106, average processing is performed of the air-fuel ratio feedback correction factor FAF every skip or every prescribed time length to thereby calculate an averaged value FAFAV of the air-fuel ratio feedback correction factor, thereby terminating the program.

[Purge Percentage Control]

Figure 4:
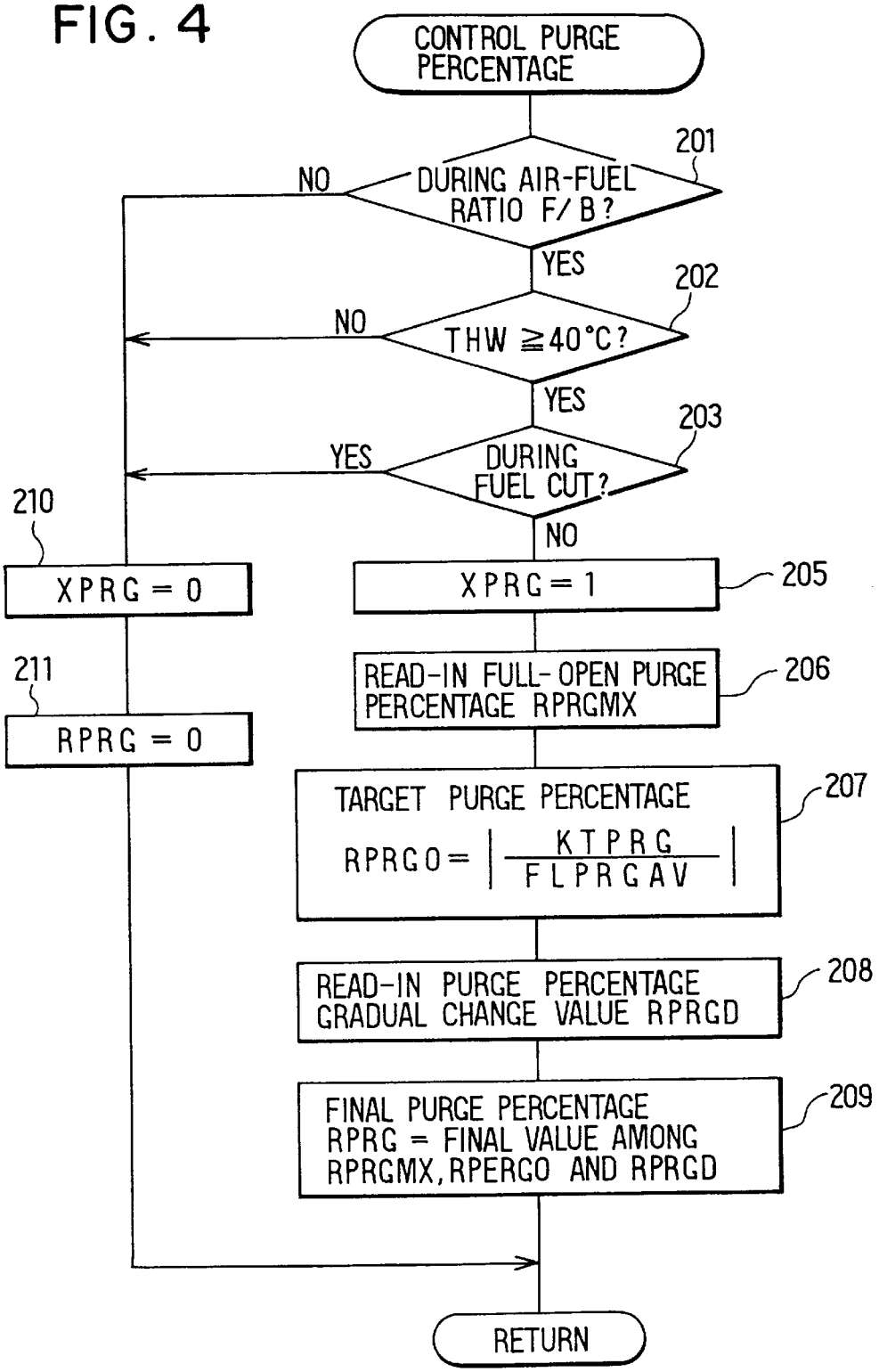
FIG. 4 is a flow diagram illustrating the flow of a process for executing a percentage-of-purge control program.

The percentage-of-purge control is executed as an interruption process, for example, every 32 milliseconds, according to a percentage-of-purge control program illustrated in FIG. 4. First, at steps 201 to 203, it is determined whether the purge execution conditions are established. Purge execution conditions include: (1) the cooling water temperature THW≧40° C. (step 201), (2) the operational state of the system is during an air-fuel ratio feedback execution (step 202), and (3) the supply state of the fuel is not during a fuel cut (step 203). Unless every one of these conditions items (1) to (3) is satisfied, the purge execution conditions are not established. The routine then proceeds to step 210 where a purge execution flag XPRG is reset to be "0" to indicate the inhibition of purge. The routine then proceeds to a subsequent step 211 where a final percentage of purge RPRG is reset to be "0", terminating the program. That this final percentage of purge RPRG is "0" means that no purge is executed. It is to be noted that in this embodiment the purging operation starts from a range of relatively low water temperature by setting the condition of the cooling water temperature THW at the time of purge execution to be the THW≧40° C.

On the other hand, if the above-described conditions (1) to (3) are all satisfied, the purge execution conditions are established and the routine proceeds to step 205 where a purge execution flag XPRG is set to be "1". The "1" indicates the execution of purge. The routine then proceeds to steps 206 to 209 where the final percentage of purge RPRG is calculated as follows. First, at step 206, from a two-dimensional map of FIG. 5, wherein the suction pipe pressure PM and the engine rotations number NE are used as parameters, there is read in a percentage of full-open purge RPRGMX corresponding to the PM and NE at that time. Thereafter, at step 207, a target TAU correction amount KTPRG is divided by a fuel evaporative emission gas concentration average value FLPRGAV to thereby calculate a target percentage of purge RPRGO (RPRGO=KTPRG/FLPRGAV).

Here, the target TAU correction amount KTPRG corresponds to a maximum amount of correction when performing quantitative decrement correction with respect to the fuel injection amount TAU at the time of purge execution. This target TAU correction amount KTPRG is present according to the degree of allowance for a minimum amount of injection of the fuel injection valve 17. The target TAU correction amount KTPRG corresponding to the suction pipe pressure PM and the engine rotations number NE at the relevant time is read in from a two-dimensional map of FIG. 6, wherein PM and NE are used as parameters. Also, the fuel evaporative emission gas concentration average value FLPRGAV corresponds to the amount of fuel evaporative emission gas adsorption within the canister 32, and is estimated by a later described process and written into the RAM 43 while being constantly updated.

Accordingly, the target purge percentage RPRGO that is calculated at step 207 means the amount of fuel evaporative emission gas that must be supplemented by purge under the assumption that the amount of fuel injection be decremented down to a value that corresponds to the target TAU correction amount KTPRG. In this case, assuming that the operational state of the engine is the same, the greater the fuel evaporative emission gas concentration average value FLPRGAV, the smaller the target purge percentage RPRGO.

At step 208, after the calculation of the target purge percentage RPRGO, a purge percentage gradual change value RPRGD, that has been calculated according to a purge percentage gradual change control program of FIG. 7 as later described, is read. Here, the purge percentage gradual change value RPRGD is a control value provided to avoid the failure to keep an optimum A/F ratio that results when the purge percentage is rapidly changed, and no correction follows this change.

After calculation has been performed of the full-open purge percentage RPRGMX, target purge percentage RPRGO, and purge percentage gradual change value RPRGD as described above, the routine proceeds to step 209 where a minimum value among these values is determined as the final purge percentage RPRG. The purge control is executed using this final purge percentage RPRG. Ordinarily, the final purge percentage RPRG is controlled by the purge percentage gradual change value RPRGD. If this purge percentage gradual change value RPRGD continues to increase, the final purge percentage RPRG has its upper limit guarded by the full-open purge percentage RPRGMX or target purge percentage RPRGO.

[Purge Percentage Gradual Change Control]

Figure 7:
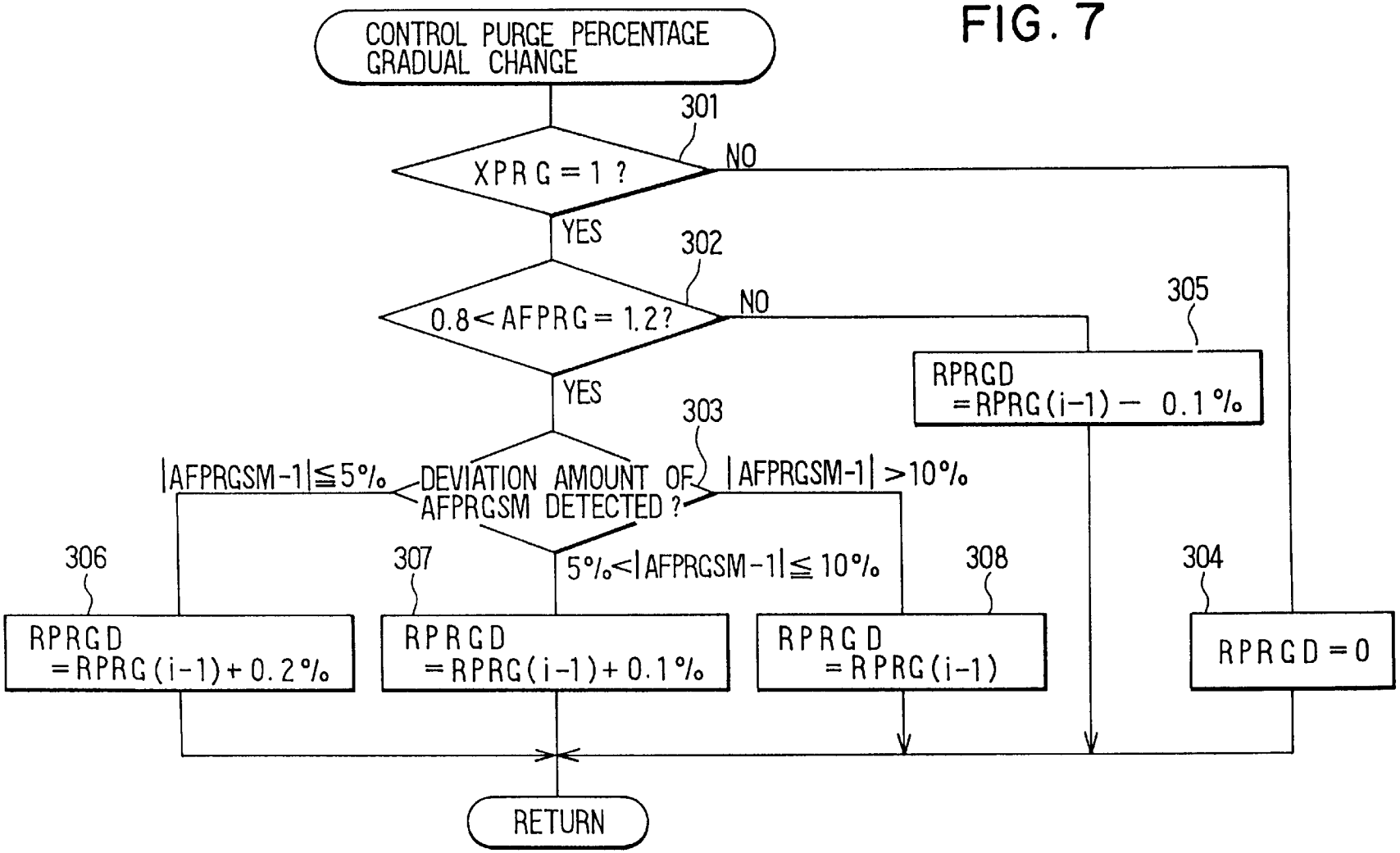
FIG. 7 is a flow diagram illustrating the flow of a process for executing a percentage-of-purge gradual change control program.

The purge percentage gradual change control is executed as an interruption process, for example, every 32 milliseconds, according to the purge percentage gradual change control program illustrated in FIG. 7. First, at step 301, it is determined whether a purge execution flag XPRG is "1" indicating the execution of purge. When XPRG=0, namely when no purge is executed, the routine proceeds to step 304 where the purge percentage gradual change value RPRGD is set to be "0". The program is then terminated.

On the other hand, when XPRG=1 (when purge is executed), the routine proceeds to step 302 where it is determined whether a purge control amount AFPRG, having been calculated at step 602 of a purge control amount calculation program of FIG. 12 as later described, falls within a range of from 0.8 to 1.2. When the purge control amount AFPRG is under 0.8 or over 1.2, the routine proceeds to step 305 where a value obtained by subtracting "0.1%" from the previous final purge percentage RPRG (i−1) is set as the present purge percentage gradual change value RPRGD.

Also, when 0.8<AFPRG<1.2, the routine proceeds from step 302 to step 303 where it is determined to what extent a purge control amount average value AFPRGSM calculated at step 602 of FIG. 12 as later described is deviated from a reference value (=1). Thus, determination is made of this amount of deviation |AFPRGSM−1|. At this time, if |AFPRGSM−1|≦5%, the routine proceeds to step 306 where a value obtained by adding "0.2%" to the previous final purge percentage PFR (i−1) is set as the present purge percentage gradual change value PFRD. Also, if 5% <|AFPRGSM−1|≦10%, the routine proceeds to step 307 where a value obtained by adding "0.1%" to the previous final purge percentage RPRG (i−1) is set as the present purge percentage gradual change value RPRGD. Also, if |AFPRGSM −1|>10%, the routine proceeds to step 308 where the previous final purge percentage RPRG (i−1) is set as the present purge percentage gradual change value.

Figure 8:
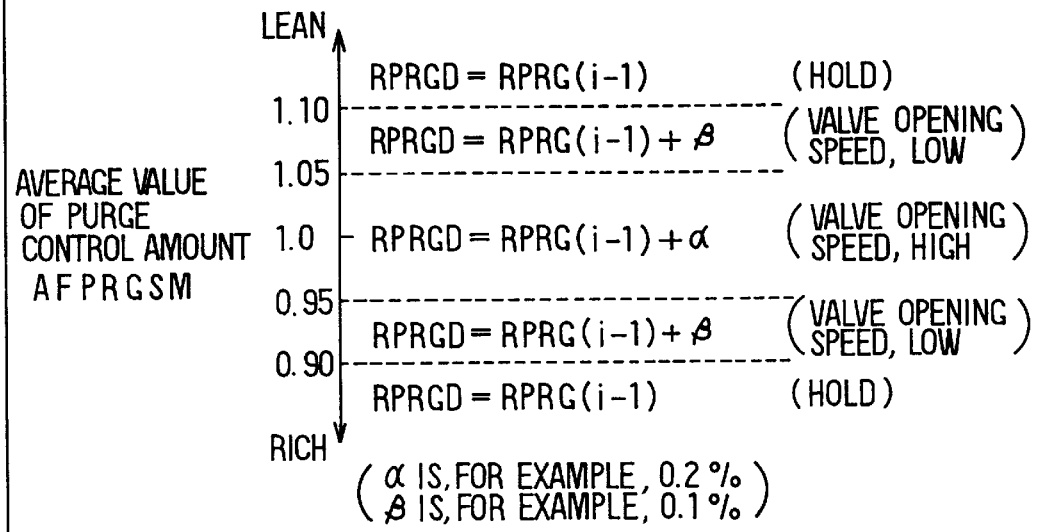
FIG. 8 illustrates a method of calculating a percentage-of-purge gradual change value RPRGD.

The above-explained calculation method of calculating the purge percentage gradual change value RPRGD will be more easily understood by referring to the summary diagram in FIG. 8.

[Fuel Evaporative Emission Gas Concentration Detection]

Figure 9:
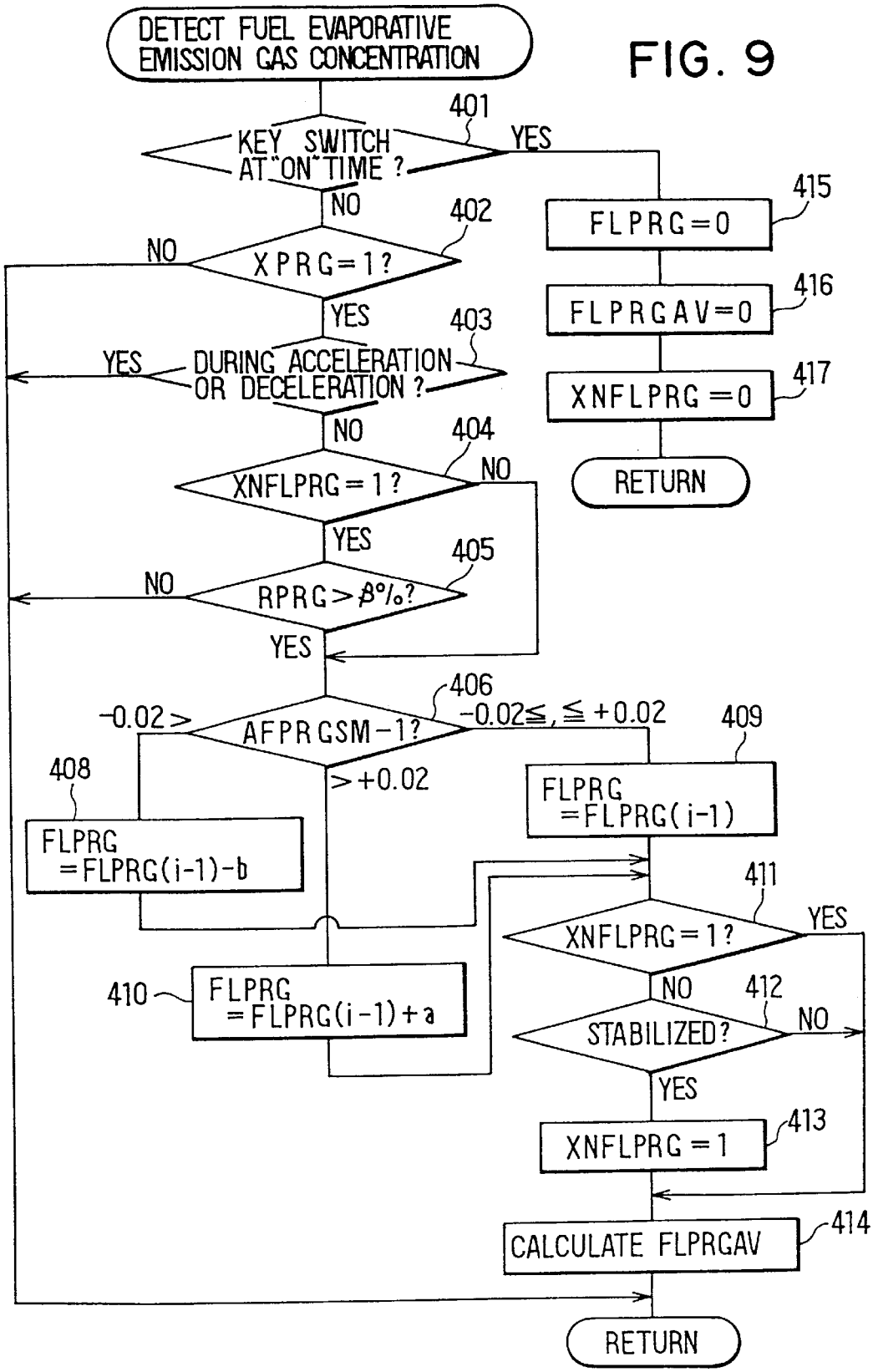
FIG. 9 is a flow diagram illustrating the flow of a process for executing a fuel evaporative emission gas concentration detection program.

The fuel evaporative emission gas concentration detection is executed as an interruption process, for example, every 4 milliseconds, according to the fuel evaporative emission gas concentration detection program illustrated in FIG. 9. First, at step 401, it is determined whether the present detection time is the time at which the key switch has been made "on". If "YES" determination is made, respective data items are initialized at steps 415 to 417, whereby settings are performed such that the fuel evaporative emission gas concentration FLPRG=0, fuel evaporative emission gas concentration average value FLPRGAV=0 and initial concentration detection termination flag XNFLPRG=0.

Here, the settings of the fuel evaporative emission gas concentration FLPRG=0 and fuel evaporative emission gas concentration average value FLPRGAV=0 mean that the fuel evaporative emission gas concentration is "0" (in other words that the fuel evaporative emission gas is not adsorbed at all within the canister 32). When starting the engine up, it is assumed that the amount of adsorption is "0" by initialization. The initial concentration detection termination flag XNFLPRG=0 means that the fuel evaporative emission gas concentration has not yet been detected after start-up of the engine.

After the key switch has been turned "on", the flow proceeds to step 402 where it is determined whether a purge execution flag XPRG is "1", namely whether the purge control has been started. Here, when XPRG=0 (before the purge control is started), the program is terminated. On the other hand, when XPRG=1 (after the purge contol is started), the routine proceeds to step 403 where it is determined whether the vehicle is in an operational state of acceleration or deceleration. Here, the determination of whether the vehicle is being accelerated or decelerated is made according to the detected results regarding, for example, an "off" state of an idle switch (not illustrated), a change in the valve opening degree of the throttle valve 13, a change in the suction pipe pressure, or a change in the vehicle speed. When it has been determined that the vehicle is being accelerated or decelerated, the program is terminated. That is, when the vehicle is in a state of acceleration or deceleration (in a transition state of engine operation), the detection of the fuel evaporative emission gas concentration is inhibited, whereby erroneous detection is prevented.

Also, when it has been determined that the vehicle is not in the state of acceleration or deceleration at step 403, the routine proceeds to step 404 where it is determined whether an initial concentration detection termination flag XNFPRG is "1", namely whether initial detection of the fuel evaporative emission gas concentration has been terminated. Here, if the XNFPRG=1 (after initial detection is made), the routine proceeds to step 405. If the XNFPRG=0 (before initial detection is made), the routine skips step 405 and step 406.

Initially, since the fuel evaporative emission gas concentration is not terminated (XNFLPRG=0), the routine proceeds from step 404 to step 406 where the extent that an average value AFPRGSM of the purge control amount AFPRG is deviated from a reference value (=1) is determined. If the AFPRGSM−1<−0.02, the routine proceeds to step 408 where a value obtained by subtracting a prescribed value "b" from the previous fuel evaporative emission gas concentration FLPRG (i−1) is set as the present fuel evaporative emission gas concentration FLPRG. Also, when $-0.02 \leqq AFPRGSM-1 \leqq +0.02$, the routine proceeds to step 409 where the previous fuel evaporative emission gas concentration (i−1) is set as the present fuel evaporative emission gas concentration FLPRG. Also, when the AFPRGSM−1>+0.02, the routine proceeds to step 410 where a value obtained by adding a prescribed value "a" to the previous fuel evaporative emission gas concentration FLPRG (i−1) is set as the present fuel evaporative emission gas concentration FLPRG. In this case, the prescribed value "a" is set to be smaller than the prescribed value "b", as when the fuel evaporative emission gas concentration is low, this concentration is only gradually raised even with the execution of purge.

Figure 10:
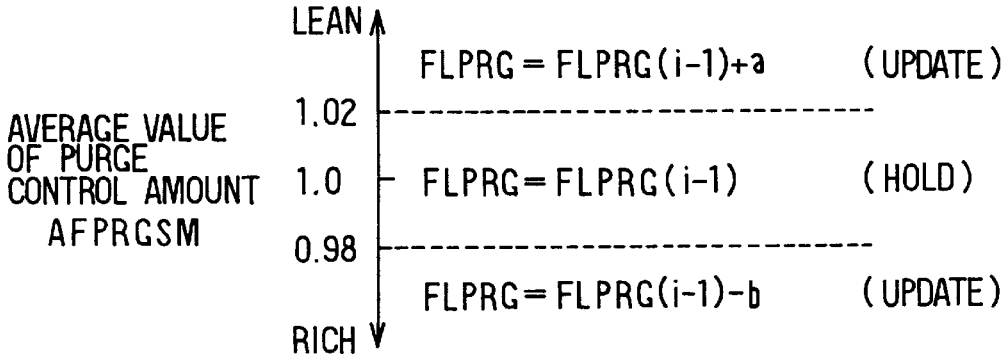
FIG. 10 illustrates a method of altering a learned value of a fuel evaporative emission gas concentration FLPRG.

By the above-described initialization processing, the initial value of the fuel evaporative emission gas concentration FLPRG is set to be "0" (step 415). And, by the processings executed in the steps 406 to 410, the learned value of the fuel evaporative emission gas concentration FLPRG is gradually updated according to the amount of deviation of the purge control amount average value AFPRGSM. The updating method of updating the learned value of the fuel evaporative emission gas concentration FLPRG will be more easily understood by referring to the summary diagram in FIG. 10.

After the learned value of the fuel evaporative emission gas concentration FLPRG has been updated, the routine proceeds to step 411 where it is determined whether the initial concentration detection termination flag XNFLPRG is "1", indicating the termination of the initial concentration detection. If the XNFLPRG=0 (before initial concentration detection is made), the routine proceeds to step 412 where it is determined whether the fuel evaporative emission gas concentration FLPRG has been stabilized according to whether the change of the present fuel evaporative emission gas concentration FLPRG relative to the previous one is under a prescribed value (e.g., 3%) continues to occur, for example, three or more times. When the fuel evaporative emission gas concentration FLPRG is stabilized, the routine proceeds to step 413 in which the initial concentration detection termination flag XNFLPRG is set to be "11", after which the routine proceeds to step 414.

On the other hand, when the XNFLPRG=1 (initial concentration detection termination) at step 411, or when it has been determined at step 412 that the fuel evaporative emission gas concentration FLPRG is not yet stabilized, the routine proceeds to step 414 where, in order to average the present fuel evaporative emission gas concentration FLPRG, a prescribed averaging calculation (e.g., 1/64 averaging calculation) is executed to determine a fuel evaporative emission gas concentration average value FLPRGAV.

When the initial concentration detection is terminated in this way (the XNFLPRG=1 is so set), the determination at step 404 is always made as "YES", and the routine proceeds to step 405 where it is determined whether the final purge percentage RPRG exceeds a prescribed value β (e.g., 0%). And, only when the RPRG>β, the learning processing for learning the fuel evaporative emission gas concentration is executed at step 406 and its subsequent steps. Namely, even when the purge execution flag XPRG is being set to be "1", there is a case where the final purge percentage RPRG becomes "0". In such a case, since no purge is actually executed, it is arranged that when the RPRG=0 no detection is performed of the fuel evaporative emission gas concentration excepting when initial detection is made.

Incidentally, when the final purge percentage RPRG is low, namely when the purge control valve 35 is being controlled on a low flowrate side, the precision with which the degree of opening thereof is controlled is relatively low, so that the reliability on the fuel evaporative emission gas concentration detection is low. On this account, it may be arranged to set the prescribed value β of the step 405 to be in a range of low opening of the purge control valve 35 (e.g., 0%<β<2%) and, at other times than that when initial detection is made, to detect the fuel evaporative emission gas concentration only when the conditions enabling an increase in the precision have been established.

[Fuel Injection Amount Calculation]

Figure 11:
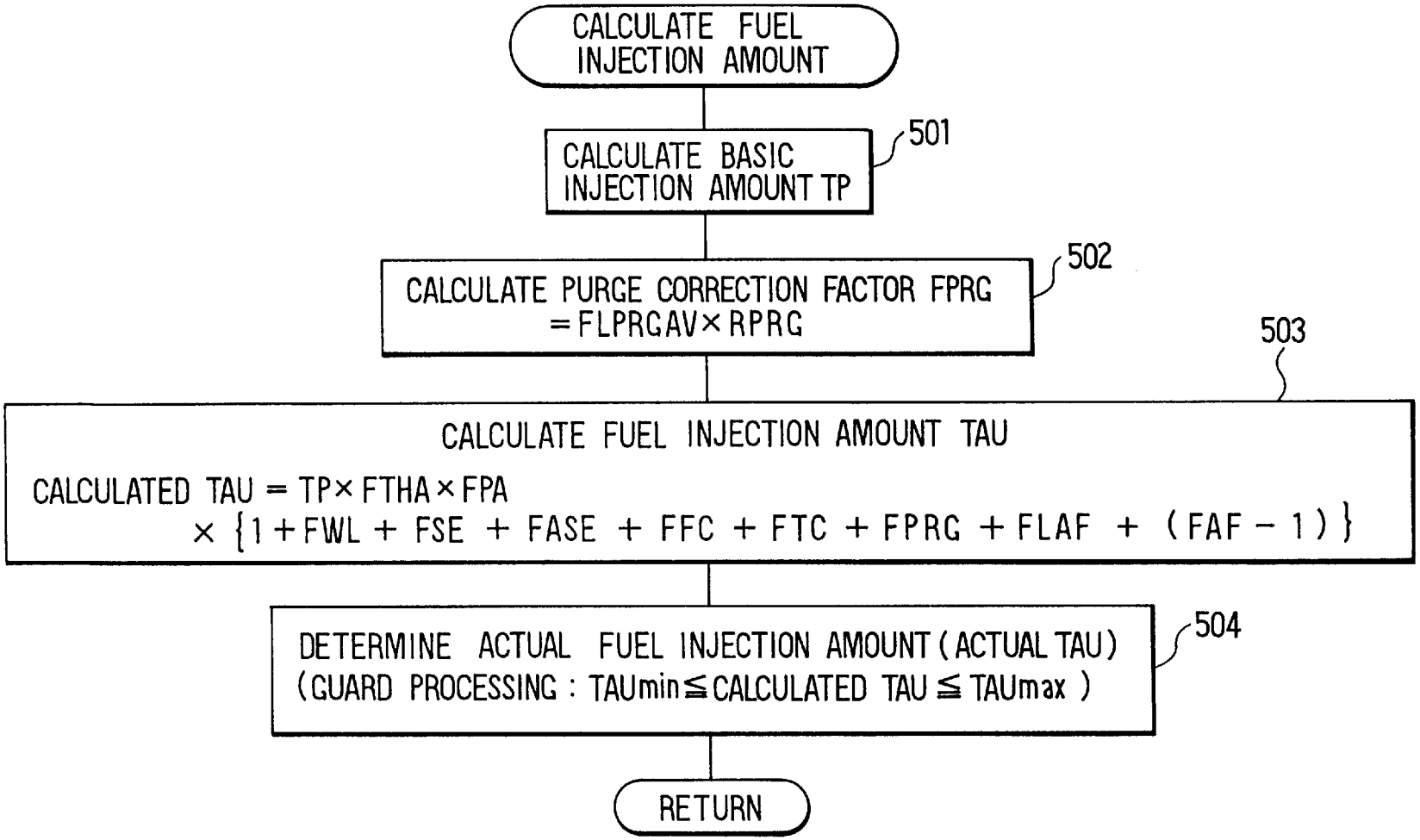
FIG. 11 is a flow diagram illustrating the flow of a process for executing an amount-of-fuel-injection calculation program.

The fuel injection amount calculation is executed as an interruption process, for example, every 4 milliseconds, according to the fuel injection amount calculation program illustrated in FIG. 11. First, at step 501, a basic amount of injection (basic time period of injection) TP corresponding to the engine rotations number NE and load (e.g. the suction pipe pressure PM) according to the data stored in the ROM 42 as a map is calculated. At step 502, the purge correction factor FPRG is calculated by multiplying the fuel evaporative emission gas concentration average value FLPRGAV by the final purge percentage RPRG (FPRG=FLPRGAV×RPRG).

Thereafter, at step 503, the calculated value (calculated TAU) of the fuel injection amount TAU is calculated according to the following equation.

$$\text{Calculated TAU}=TP\times FTHA\times FPA\times\{1+FWL+FSE+FASE+FFC+FTC+FPRG+FLAF+(FAF-1)\}$$

where TP: basic amount of injection (basic time period of injection)

FTHA: suction air temperature correction factor

FPA: atmospheric pressure correction factor

FWL: warm-up correction factor

FSE: start-up time correction factor

FASE: post-startup correction factor

FFC: fuel cut restoration time correction factor

FTC: acceleration/deceleration correction factor

FPRG: purge correction factor

FLAF: air-fuel ratio learning correction factor, and

FAF: air-fuel ratio feedback correction factor

At step 504, the calculated TAU is guard processed by a lower-limit guard value TAUmin and upper-limit guard value TAUmax corresponding to a minimum/maximum amount of injection of the fuel injection valve 17 to thereby determine an amount of fuel injection (actual TAU) that is actually injected from the fuel injection valve 17. That is, although in a range of TAUmin≦calculated TAU≦TAUmax the actual TAU=calculated TAU, processing is executed in a region wherein the calculated TAU is out of the range of from the guard value TAUmin to the guard value TAUmax guard, with the result that the actual TAU=TAUmin or TAUmax. The processing executed at step 504 serves as actual-amount-of-fuel-injection determining means referred to in the appended "claims".

The CPU 41 outputs an actual TAU instruction to the fuel injection valve 17 with a prescribed fuel injection timing, thereby executing the injection of fuel.

[Purge Control Amount Calculation]

Figure 12:
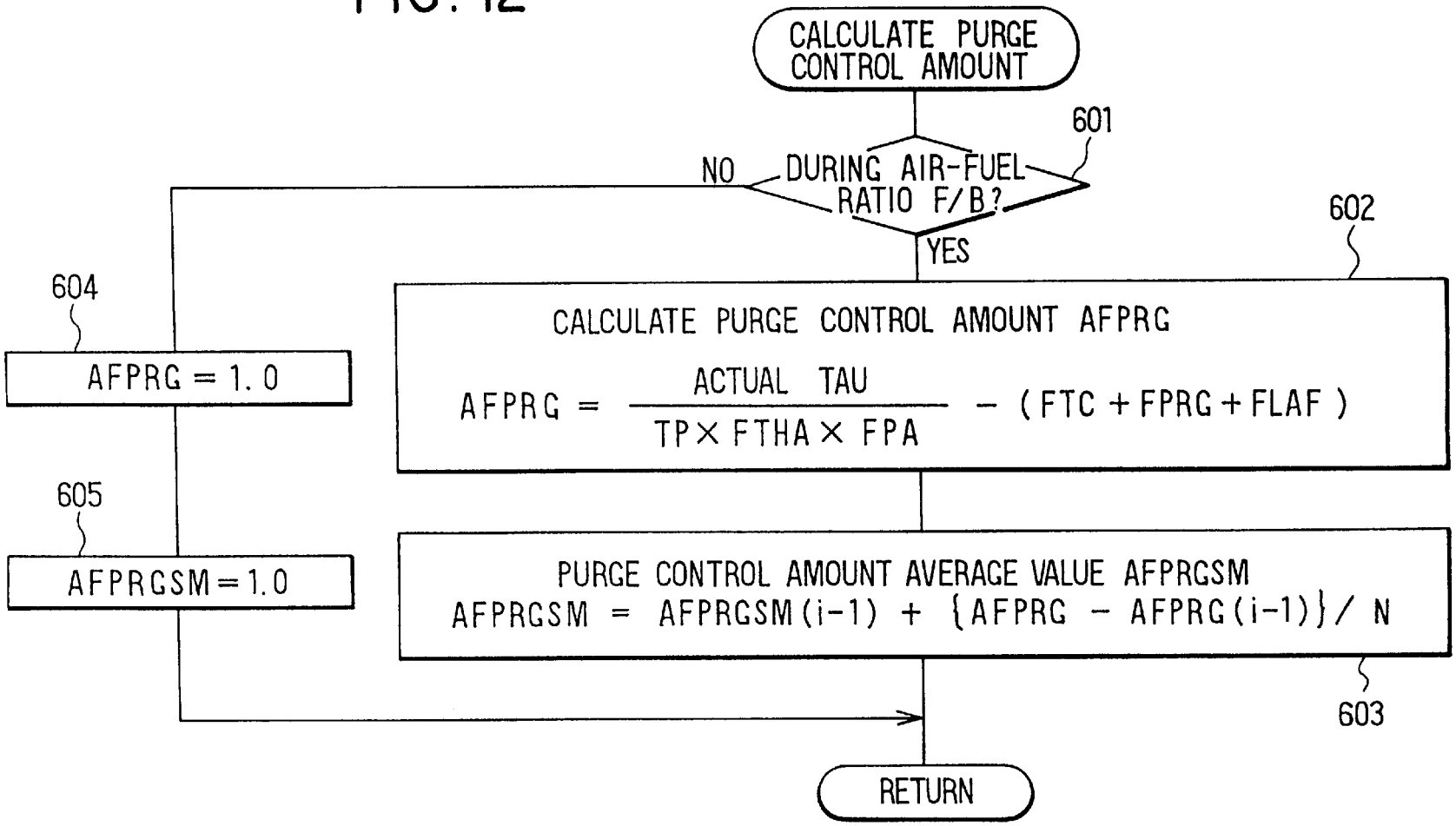
FIG. 12 is a flow diagram illustrating the flow of a process for executing an amount-of-purge-control calculation program.

The purge control amount calculation is executed as an interruption process, for example, every 32 milliseconds, according to the purge control amount calculation program illustrated in FIG. 12. First, at step 601, it is determined whether the present calculation time is during the air-fuel ratio feedback operation. If a "NO" determination is made, since no purge control is executed, the routine proceeds to step 604 and then to step 605, whereby the purge control amount AFPRG and the average value AFPRGSM are respectively set to be "1.0". The program is then terminated.

On the other hand, if the present calculation time is during the air-fuel ratio feedback operation, the routine proceeds to step 602 where the purge control amount AFPRG is calculated using the calculated TAU according to the following equation.

$$AFPRG=actual\ TAU/(TP\times FTHA\times FPA)-(FTC+FPRG+FLAF)$$

where TP: basic amount of injection

FTHA: suction air temperature correction factor

FPA: atmospheric pressure correction factor

FTC: acceleration/deceleration correction factor

FPRG: purge correction factor, and

FLAF: air-fuel ratio learning correction factor,

In the second member of the right side of the above equation, air-fuel ratio fluctuating factors other than purge (the warm-up correction factor FWL, start-up time correction factor FSE, post-startup correction factor FASE and fuel cut restoration time correction factor FFC) are excluded, among the air-fuel ratio fluctuating factors. As a result, the purge control amount AFPRG is calculated by using only the air-fuel ratio fluctuating purge factor (FPRG) resulting from purge as parameters. It is to be noted that this purge control amount AFPRG may be guard processed considering a control range for controlling the purge control valve 35.

Thereafter, at step 603, the average value AFPRGSM of the purge control amount AFPRG is calculated according to the following averging equation.

$$AFPRGSM=AFPRGSM\ (i-1)+(AFPRG-AFPRG(i-1))/N$$

where the AFPRGSM (i−1) represents the average value of the previous purge control amount, the AFPRG (i−1) represents the previous purge control amount, and the N represents an averaging coefficient.

[Control Of Purge Control Valve]

Figure 13:
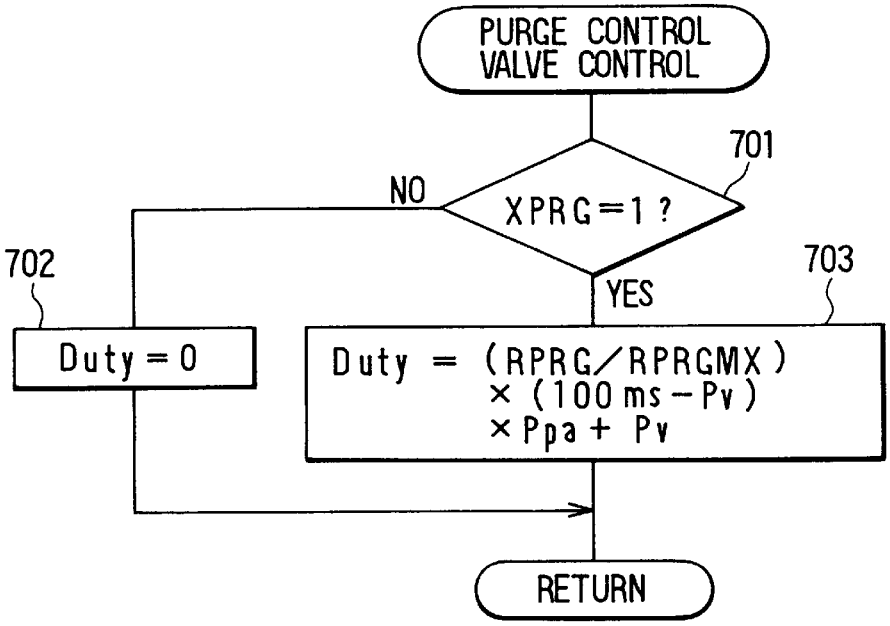
FIG. 13 is a flow diagram illustrating the flow of a process for executing a purge control valve control program.

The control of the purge control valve 35 is executed as an interruption process, for example, every 100 milliseconds, according to the purge control valve control program illustrated in FIG. 13. First, at step 701, it is determined whether the purge execution flag XPRG is "1", indicating the execution of purge. If the XPRG=0 (non-execution of purge), the routine proceeds to step 702 where the control value DUTY for driving the purge control valve 35 is set to is "0", whereby the purge control valve 35 is fully closed to stop the execution of purge.

Also, if the XPRG=1 (execution of purge), the routine proceeds to step 703 where the control value DUTY is calculated according to the final purge percentage RPRG and the full-open purge percentage RPRGEMX corresponding to the operational state prevailing at the present control time by the use of the following equation.

$$DUTY=(RPRG/RPRGMX)\times(100\ ms-Pv)\times Ppa+Pv$$

In this equation, the drive period of the purge control valve 35 is set to be 100 msec. Also, Pv represents the voltage correction value with respect to the battery voltage that corresponds to the drive period correction time length, and Ppa represents the atmospheric correction value with respect to the fluctuation of the atmospheric pressure. According to the control value DUTY calculated using the above equation, the duty ratio of the drive pulse signal of the purge control valve 35 is set, whereby the opening of the purge control valve 35 is controlled.

[Control Examples]

The behaviors of the fuel evaporative emission gas purge controls according to the above-described respective programs will now be explained using the timing diagrams illustrated in FIGS. 14 and 15.

Figure 14:
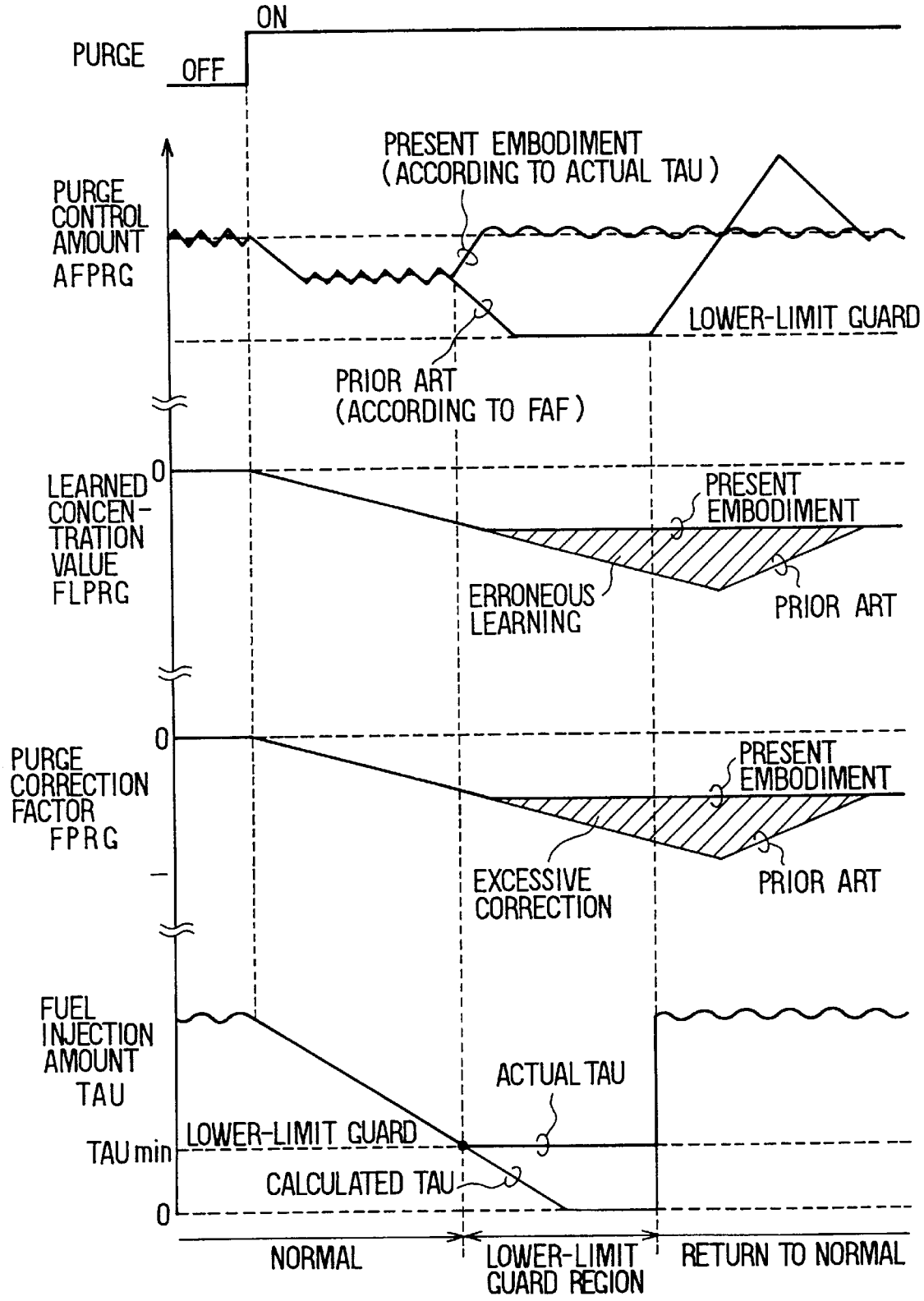
FIG. 14 is a timing diagram illustrating behaviors that are exhibited when during a purge execution a calculated TAU falls below a lower-limit guard value TAUmin.

FIG. 14 illustrates the behaviors that are exhibited when purge is started and, during the execution of purge, when the calculated TAU falls below the lower-limit guard value TAUmin. Up to the point in time at which the calculated TAU reaches the lower-limit guard value TAUmin, the calculated TAU coincides with the actual TAU. Therefore, the behaviors which are exhibited during the conventional purge control made using the FAF (calculated TAU) and those which are exhibited during the purge control according to the present invention made using the actual TAU coincide with each other.

Thereafter, when the calculated TAU falls below the lower-limit guard value TAUmin, the guarding operation works thereon, with the result that the actual TAU is fixed at the lower-limit guard value TAUmin. As a result, the behaviors which are exhibited during the conventional purge control made using the FAF (calculated TAU) and those which are exhibited during the purge control according to the present invention made using the actual TAU differ from each other. Namely, in this embodiment, when the calculated TAU falls below the lower-guard value TAUmin, the actual TAU is fixed at the lower-limit guard value TAUmin. Therefore, after a while, the purge control amount AFPRG becomes fixed at a reference value, the learned value of the fuel evaporative emission gas concentration FLPRG also becomes fixed, and the purge correction factor FPRG that is set according to this learned value also becomes fixed.

In contrast to this, in the conventional purge control performed using the FAF (calculated TAU), even after the calculated TAU has fallen below the lower-limit guard value TAUmin, the purge control amount AFPRG continues to fall with a decrease in the calculated TAU, and the learned value of the fuel evaporative emission gas concentration FLPRG and the purge correction factor FPRG also continue to fall. For this reason, the hatched region of the learned value of the fuel evaporative emission gas concentration FLPRG becomes an erroneously learned region, and the hatched region of the purge correction factor FPRG also becomes an excessively corrected region. As a result, it is impossible to perform an accurate air-fuel ratio feedback control based on the consideration of the effect of purge, which results in deterioration of exhaust emission.

In this embodiment, since the purge control amount AFPRG is calculated according to the actual TAU, it is possible to avoid the erroneous learning of the fuel evaporative emission gas concentration FLPRG and the excessive correction of the purge correction factor FPRG. This makes it possible to determine the purge control amount AFPRG corresponding to the actual TAU. Therefore, a highly precise air-fuel ratio feedback control may be performed based on the consideration of the effect of purge. This makes it possible to avoid the deterioration of the exhaust emission resulting from purge.

Figure 15:
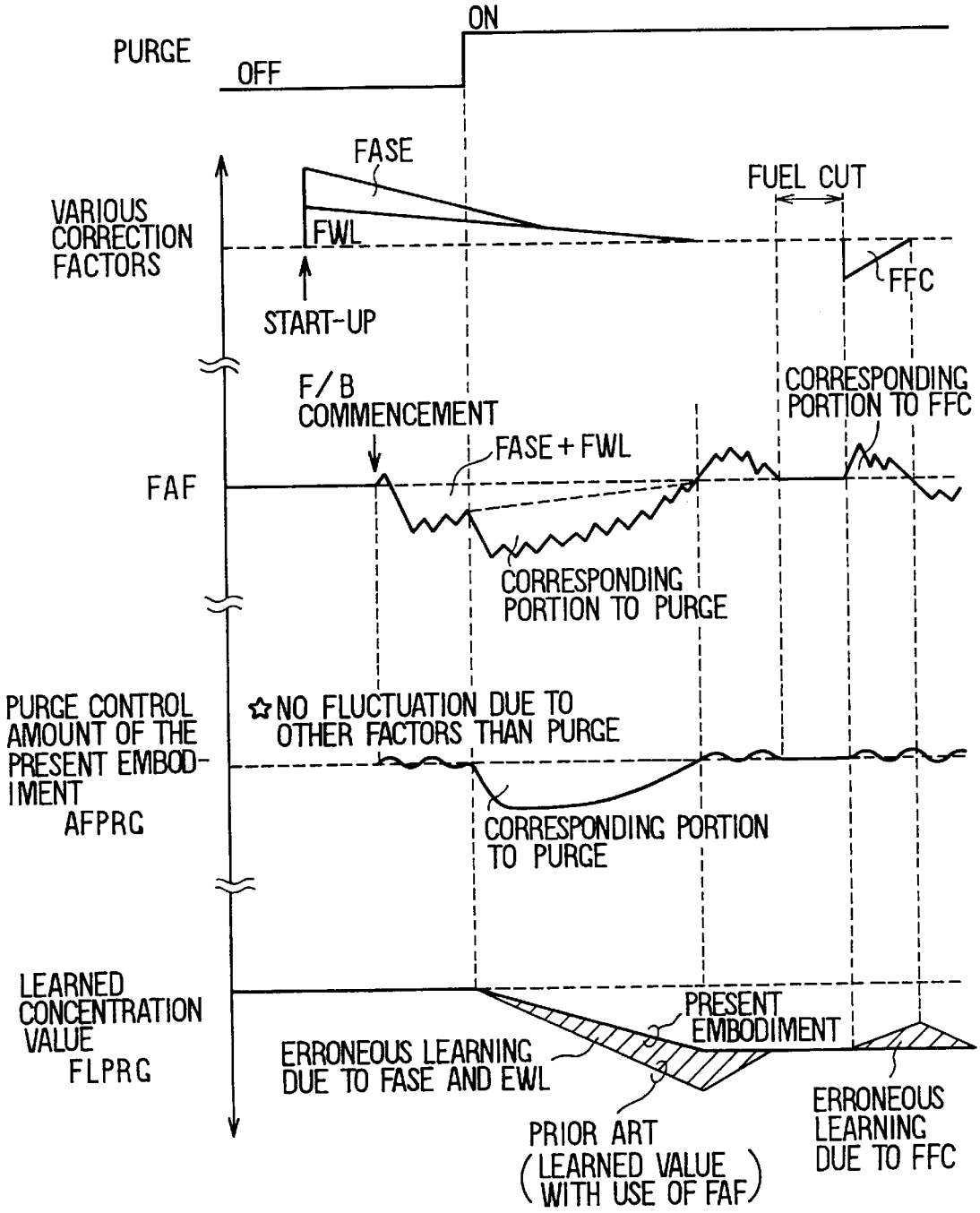
FIG. 15 is a timing diagram illustrating behaviors that are exhibited when an air-fuel ratio feedback operation is commenced after start-up of an engine and thereafter a purge operation is commenced.

On the other hand, FIG. 15 illustrates the behaviors that are exhibited when, after the start-up of the engine, the air-fuel ratio feedback operation is commenced, and thereafter purge is commenced. From immediately after the start-up of the engine, the post-startup correction factor FASE and the warm-up correction factor FWL are set. In this set state, the air-fuel ratio feedback is commenced. As a result, the respective fluctuating portions resulting from the post-startup correction factor FASE and the warm-up correction factor FWL are added to the air-fuel ratio feedback correction factor FAF. Thereafter, when purge is commenced, the fluctuating portion resulting from purge is added to the FAF. Also, when a fuel cut is performed, immediately after the restoration from this fuel cut, the fluctuating portion resulting from a fuel cut restoration time correction factor FFC is added to the FAF.

Conventionally, since purge control was performed according to the FAF (calculated TAU), it is impossible to take out only the FAF fluctuating portion resulting solely from purge. Therefore, fluctuating factors (FASE, FEL, FFC) other than purge are inconveniently contained in the learned value of the fuel evaporative emission gas concentration FLPRG. Therefore, the hatched portions thereof become erroneously learned regions, with the result that an accurate air-fuel ratio feedback control based on the consideration of the effect of purge cannot be executed, resulting in the exhaust emission becoming inconveniently deteriorated.

In contrast to this, air-fuel ratio fluctuating factors (the warm-up correction factor FWL, start-up time correction factor FSE, post-startup correction factor FASE and fuel cut restoration time correction factor FFC) other than purge, among the air-fuel ratio fluctuating factors, are excluded from the calculation equation for the purge control amount AFPRG. As a result, the purge control amount AFPRG is calculated by using only the air-fuel ratio fluctuating purge factor (FPRG) resulting from purge as parameters (step 602 in FIG. 12). Therefore, it is possible to take out only the fluctuating portion resulting solely from purge. This makes it possible to prevent the erroneous learning of the fuel evaporative emission gas concentration FLPRG due to the inclusion of other air-fuel ratio fluctuating factors than purge. This makes it possible to enhance the precision with which this concentration is learned and therefore to execute a highly precise air-fuel ratio feedback control based on the consideration of the effect of purge.

It is to be noted that, in the calculation equation for the purge control amount AFPRG used in step 602 in FIG. 12, it may be also arranged to calculate the purge control amount AFPRG according to the following equation using the calculated TAU in place of the actual TAU.

$$AFPRG=\text{calculated TAU}/(TP\times FTHA\times FPA)-(FTC+FPRG+FLAF)$$

In this case, also, since air-fuel ratio fluctuating factors other than purge are excluded from the second member of the right side of the above equation, it is possible to enhance the calculation precision of the purge control amount AFPRG compared to the conventional purge control and therefore to enhance the precision of the air-fuel ratio feedback control.

It may be also arranged to calculate the purge control amount AFPRG according to the following equation.

$$AFPRG=\text{actual TAU}/(TP\times FTHA\times FPA)-(FWL+FSE+FASE+FFC+FTC+FPRG+FLAF)$$

In this case, although in the second member of the right side air-fuel ratio fluctuating factors (the warm-up correction factor FWL, start-up time correction factor FSE, post-startup correction factor FASE and fuel cut restoration time correction factor FFC) other than purge are included, since the purge control amount AFPRG is calculated based on the actual TAU, it is possible to enhance the calculation precision of the purge control amount AFPRG compared to the conventional purge control that uses the calculated TAU to enhance the precision of the air-fuel ratio feedback control.

What is claimed is:

1. An air-fuel ratio control system for an internal combustion engine that is connected to a fuel tank and that includes at least one fuel injection valve that injects fuel into the engine, comprising:

an adsorption unit connected between the fuel tank and the internal combustion engine that adsorbs a fuel evaporative emission gas generated within the fuel tank;

a suction system that is connected between the adsorption unit and the internal combustion engine, comprising:

a purge control valve that adjustably controls a flowrate of the gas adsorbed within the adsorption unit when the gas is purged to the internal combustion engine;

first calculating means for calculating an amount of fuel to be injected by the fuel injection valve according to an operational condition of the internal combustion engine;

determining means for determining an actual amount of fuel to be injected by the fuel injection valve by performing guard processing on the calculated amount of fuel to be injected; and second calculating means for calculating an amount of the gas to be purged from the adsorption unit according to the actual amount of fuel to be injected.

2. The system of claim 1, further comprising control means for controlling the purge control valve according to the calculated amount of the gas to be purged from the adsorption unit.

3. The system of claim 1, wherein the second calculating means calculates the amount of the gas to be purged from the adsorption unit by only using the actual amount of fuel injected and an air-fuel ratio fluctuating purge factor as purge parameters.

4. The system of claim 1, further comprising learning means for learning a fuel value concentration of the gas actually purged from the adsorption unit, and correcting means for correcting the actual amount of fuel injected according to the learned fuel value concentration.

5. The system of claim 2, further comprising third calculating means for calculating a percentage of gas to be purged from the adsorption unit according to an amount of suction air and a flowrate of the purged gas, wherein the control means controls a degree of opening of the purge control valve by setting as a target the calculated percentage of gas to be purged.

6. An air-fuel ratio control system for an internal combustion engine that includes a fuel tank that is connected to the engine and a fuel injection valve that injects fuel to the engine, said system comprising:

an adsorption unit connected between a suction passage leading to the fuel injection valve and the fuel tank that adsorbs a fuel evaporative emission gas generated within the fuel tank;

a purge control valve disposed in said suction passage that controls purging of the gas adsorbed within the adsorption unit; and means that controls operation of the purge control valve including calculating means for calculating an amount of the gas to be purged from the adsorption unit by using only one air-fuel ratio fluctuating parameter as a purge parameter.

7. The system of claim 6, further comprising control means for controlling the calculating means according to the amount of the gas to be purged.

8. An air-fuel ratio control system for an internal combustion engine that is connected to a fuel tank and that includes at least one fuel injection valve for injecting fuel into the engine, the system comprising:

an adsorption unit connected between the fuel tank and the internal combustion engine that adsorbs a fuel evaporative emission gas generated within the fuel tank;

a suction system that is connected between the adsorption unit and the internal combustion engine, comprising:

a purge control valve that adjustably controls a flowrate of the gas adsorbed within the adsorption unit when the gas is purged to the internal combustion engine;

a controller that is programmed to calculate an amount of fuel to be injected by the fuel injection valve according to an operational condition of the internal combustion engine, to determine an actual amount of fuel to be injected by the fuel injection valve by performing guard processing on the calculated amount of fuel to be injected, and to determine an amount of the gas to be purged from the adsorption unit according to the actual amount of fuel to be injected.

9. The system of claim 8, wherein the controller is further programmed to control the purge control valve according to the calculated amount of the gas to be purged from the adsorption unit.

10. The system of claim 8, wherein the controller calculates the amount of the gas to be purged from the adsorption unit by only using the actual amount of fuel injected and an air-fuel ratio fluctuating purge factor as purge parameters.

11. The system of claim 8, wherein the controller is programmed to learn a fuel value concentration of the gas actually purged from the adsorption unit, and to correct the actual amount of fuel injected according to the learned fuel value concentration.

12. The system of claim 9, wherein the controller is further programmed to calculate a percentage of gas to be purged from the adsorption unit according to an amount of suction air and a flowrate of the purged gas to control a degree of opening of the purge control valve by setting as a target the calculated percentage of gas to be purged.

13. An air-fuel ratio control system for an internal combustion engine that is connected to a fuel tank and including a fuel injection valve that injects a fuel to the engine, said system comprising:

an adsorption unit connected between a suction passage leading to the fuel injection valve and the fuel tank that adsorbs a fuel evaporative emission gas generated within the fuel tank;

a purge control valve disposed in said suction passage that controls purging of the gas adsorbed within the adsorption unit; and means that controls operation of the purge control valve including a controller that is programmed to calculate an amount of the gas to be purged from the adsorption unit by using only one air-fuel ratio fluctuating parameter as a purge parameter.

14. A method of controlling an air-fuel ratio in an internal combustion engine having a fuel injector that injects fuel into the engine, a fuel tank that stores fuel for combustion by the engine, and an adsorber that adsorbs evaporated fuel emitted from the fuel tank, comprising the steps of:

calculating an amount of fuel to be injected by the fuel injection valve according to an operational condition of the internal combustion engine;

performing guard processing on the calculated amount of fuel to be injected to determine an actual amount of fuel to be injected by the fuel injection valve; and calculating an amount of the gas to be purged from the adsorber according to the actual amount of fuel to be injected.

15. The method of claim 14, further comprising the step of controlling the flow of gas from the adsorber according to the calculated amount of the gas to be purged.

16. The method of claim 14, wherein the step of calculating comprises the step of calculating the amount of the gas to be purged through use of only the actual amount of fuel to be injected and an air-fuel ratio fluctuating purge factor as purge parameters.

17. The method of claim 14, further comprising the steps of learning a fuel value concentration of the gas actually purged from the adsorber, and correcting the actual amount of fuel injected according to the learned fuel value concentration.

18. The system of claim 6 wherein said air-fuel fluctuating parameter is a purge correction factor.

* * * * *